United States Patent [19]

Almog

[11] 4,166,404

[45] Sep. 4, 1979

[54] HAND PUNCH

[76] Inventor: Ehud Almog, 6 Golay-Kenia St., Tel Aviv, Israel

[21] Appl. No.: 867,237

[22] Filed: Jan. 6, 1978

[30] Foreign Application Priority Data

Nov. 25, 1977 [IL] Israel ..... 53464

[51] Int. Cl.[2] ..... B26F 1/02

[52] U.S. Cl. ..... 83/167; 83/513; 83/588; 83/618; 83/633

[58] Field of Search ..... 83/167, 588, 618, 633, 83/634, 513

[56] References Cited

U.S. PATENT DOCUMENTS

| | | | |
|---|---|---|---|
| 2,436,801 | 3/1948 | Gasio | 83/633 X |
| 2,474,344 | 6/1949 | Carpenter | 83/618 X |
| 3,073,199 | 1/1963 | Yerkes | 83/633 X |
| 3,906,633 | 9/1975 | Inoue | 83/618 X |
| 4,036,088 | 7/1977 | Ruskin | 83/167 |

*Primary Examiner*—J. M. Meister

*Attorney, Agent, or Firm*—Benjamin J. Barish

[57] ABSTRACT

Described is a hand punch which can be constructed in a narrow compact form and of few and simple parts. It includes a narrow base formed with a plurality (e.g. two) punch pin openings in a straight line along the length of the base, a pair of lever arms pivotably mounted at opposite ends of the base on pivotal axes parallel to the width of the base, and punch pins received in openings in the lever arms and arranged such that a manual force applied to one of the lever arms to move same towards the base, also moves the other lever arm towards the base, and the plurality of punch pins through the openings in the base. The base is preferably constructed of a multi-leg channel member elongated in the direction of its length, the channel member having four spaced legs, the lower two of which define a compartment for receiving the paper chips, and the middle two of which define a slot for receiving the paper sheet to be punched. All the legs except the bottommost one are provided with openings for guiding the movement of the punch pins.

9 Claims, 10 Drawing Figures

FIG. 1
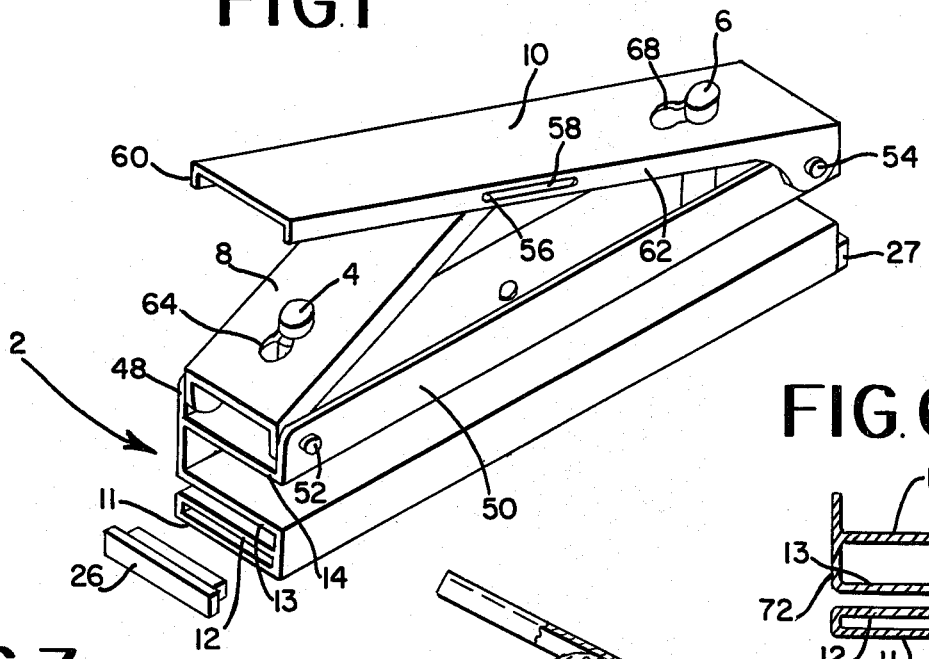
FIG. 6
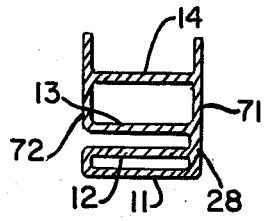
FIG. 3
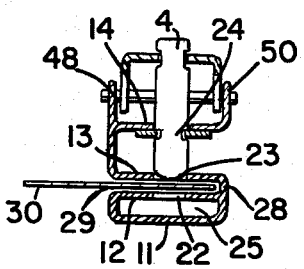
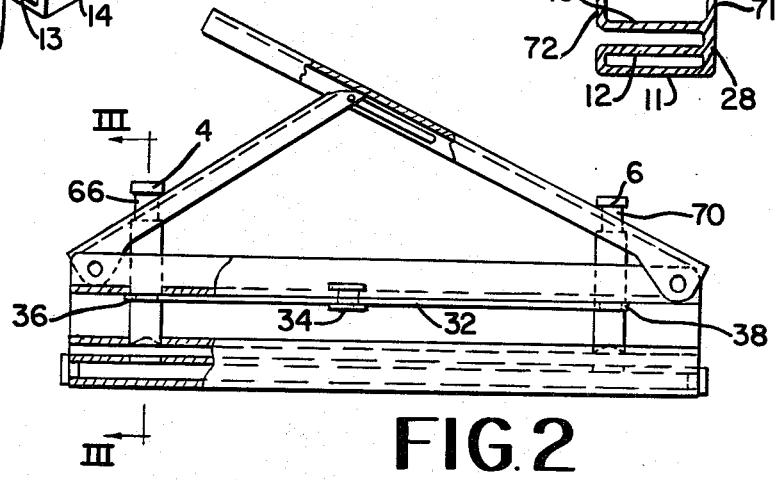
FIG. 2
FIG. 5
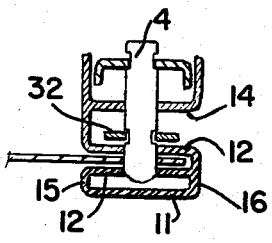
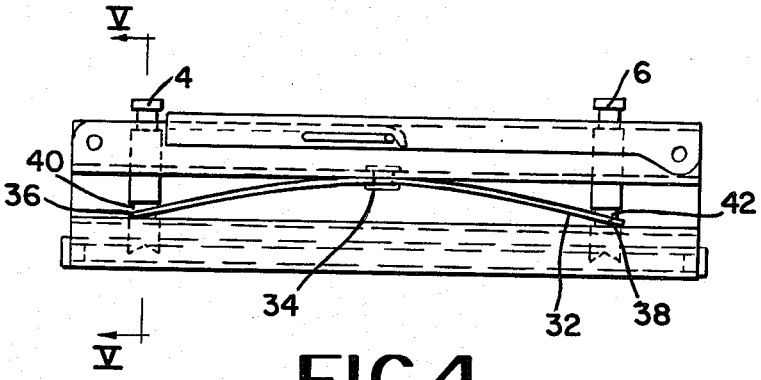
FIG. 4

HAND PUNCH

BACKGROUND OF THE INVENTION

The present invention relates to hand punches such as are commonly used for punching two (or more) openings through the margins of paper sheets before inserting them into a ring binder.

A large number of different types of hand punches of the foregoing type are now in use. Generally, they include a base formed with punch pin openings, a plurality of apertured lugs or other similar elements fixed to the base for guiding the punch pins, and a lever arm pivotably mounted on a pivotal axis parallel to the line of punch pins, i.e. the length of the base, the lever arm being pivotted downwardly in order to move the punch pins downwardly through the openings in the base and thereby to punch a paper sheet inserted between the punch pins and the apertured base. Since the hand lever, in such a hand punch construction, is pivotably mounted on an axis parallel to the length of the base, it is usually required that the base be quite wide in order to stably support it when the hand lever is manually depressed. Such hand punches therefore generally require large constructions which are expensive to produce, inconvenient to use, and bulky in the space required when not in use.

BRIEF SUMMARY OF THE INVENTION

An object of the present invention is to provide a hand punch having advantages in the above respect. More particularly, it is an object of the invention to provide a hand punch which can be constructed in a very compact form and of few and simple parts which can be inexpensively produced and assembled.

According to the present invention, there is provided a hand punch comprising: a base having a substantially longer length than width, said base being formed with a plurality of punch pin openings arranged in a straight line along the length of the base, and with a slot overlying said openings for receiving a sheet to be punched; a plurality of punch pins each normally overlying said slot and one of said openings and movable therethrough upon the manual depression of the punch; a manual operator for depressing said punch pins through said openings, said manual operator including a first lever arm pivotably mounted to one end of said base along a first pivotable axis parallel to the width of the base, and a second lever arm pivotably mounted to the opposite end of said base along a second pivotal axis parallel to said first pivotal axis; and spring return means returning the two lever arms and the plurality of punch pins upon release of said manual operator.

According to a further feature in the preferred embodiments of the invention described below, the base comprises a multi-leg channel member elongated in the direction of the length of the base, the channel member including a first leg and a second leg spaced thereover and provided with the punch pin openings, said second leg defining with the first leg a compartment for receiving the paper chips punched by the punch pins.

More particularly, the channel member further includes a third leg spaced over the second leg and formed with punch pin openings aligned with those of the second leg for guiding the punch pins. The second and third legs define the sheet-receiving slot which is open at one side for receiving the sheet to be punched by the punch pins, and is closed at the opposite side for positioning the sheet with respect to the punch pins.

The channel member additionally includes a fourth leg spaced over the third leg and formed with punch pin openings aligned with those of the third leg for guiding the punch pins.

It will be seen that the arrangement wherein the two lever arms are pivotably mounted on axes parallel to the width of the base, rather than to the length as in the previously known arrangements, enables the base to be constructed in a relatively narrow form and still stably support the hand punch during the depression of the lever arms. In addition, constructing the base of a multi-leg channel member permits the base to include few and simple parts which can be inexpensively produced and assembled by extrusion or bending.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view of one form of hand punch constructed in accordance with the invention;

FIG. 2 is a side elevational view of the hand punch of FIG. 1 showing its elements in their normal positions;

FIG. 3 is a sectional view along lines III—III of FIG. 2;

FIG. 4 is a side elevational view corresponding to that of FIG. 2 but showing the elements in their operated positions;

FIG. 5 is a sectional view along lines V—V of FIG. 4;

FIG. 6 is a sectional view illustrating a modification of the multi-leg channel member which may be used for constructing the base of the hand punch of FIG. 1;

DESCRIPTION OF PREFERRED EMBODIMENTS

Figure 7:
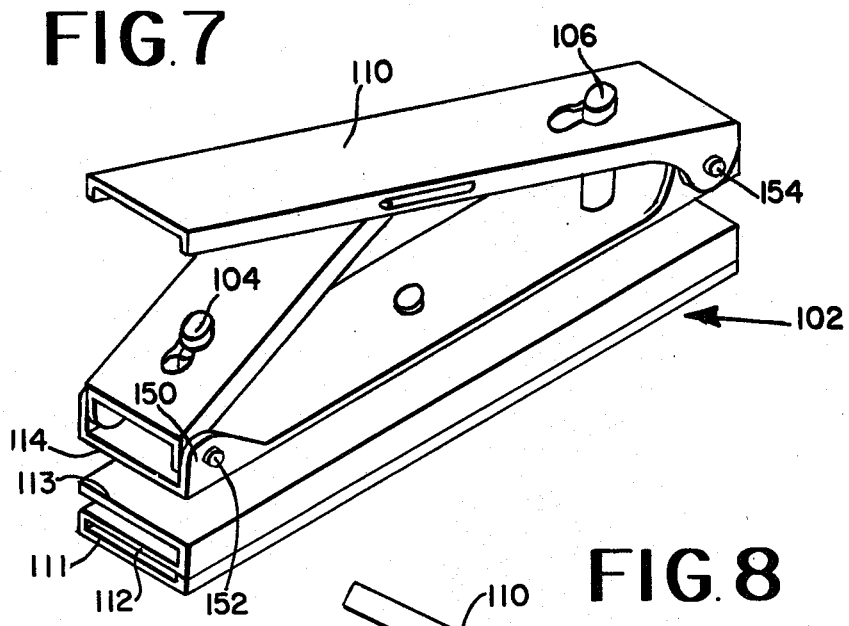
FIG. 7 is a three-dimensional view illustrating a further modified form of hand punch constructed in accordance with the invention.

The hand punch illustrated in FIGS. 1-5 comprise a base, generally designated 2, a pair of punch pins 4, 6, and a manual operator in the form of a pair of lever arms 8, 10 which are hand-depressed in order to lower the punch pins 4, 6 into the base and thereby to punch out holes of a paper sheet inserted into the base, as will be described more particularly below.

Base 2 of the hand punch is in the form of a multi-leg channel member elongated in the direction of its length. It includes four parallel legs 11, 12, 13 and 14 in overlying spaced relationship. The bottommost leg 11 is continuous and provides a flat supporting surface for the hand punch, whereas the other legs 12, 13 and 14 are each formed with punch pin openings 22, 23 and 24, respectively, aligned with each other for guiding the punch pins 4 and 6.

The two lower legs 11 and 12 are closed at their sides 15 and 16 to define a compartment 25 for receiving the paper chips (commonly called chad) removed by the punch pins. The ends of compartment are closed by removable end plugs 26, 27 (FIG. 1). One side of the juncture between legs 12 and 13 is closed, as shown by web 28, whereas the other side is opened to define a space or slot 29 for the insertion of a paper sheet 30 (FIG. 3) to be punched by the pins 4, 6, and closed side (web 28) serving as a stop engaging the end of the paper sheet for positioning it with respect to the punch pins.

Leg 14 serves as a mounting for a leaf spring 32 which is mounted at its center by means of a rivet 34 (see particularly FIGS. 2 and 4). Leaf spring 32 is used for returning the punch pins 4, 6, as well as the manual levers 8, 10, to their normal positions after they have been manually depressed to punch the holes in the paper sheet 30. For this purpose, the free ends 36, 38, of leaf spring 32 are formed with curved recesses and are received within annular recesses 40, 42 (see particularly FIG. 4) formed at an intermediate point in the two punch pins 4 and 6.

The uppermost leg 14 of the base 2 is also used for mounting the two lever arms 8 and 10. For this purpose, leg 14 is formed with an upstanding flange 48, 50 along each side. One end of lever arm 8 is pivotably mounted by means of a pin 52 to one end of the two flanges, and one end of lever arm 10 is pivotably mounted by means of a pin 54 to the opposite end of the two flanges. Lever arm 10 is longer than lever arm 8 and overlies it. The end of lever arm 8 opposite to its pivotal mounting 52 is coupled to an intermediate portion of lever arm 10 by means of a pin 56 carried by arm 8 movable within a slot 58 formed in each of two depending flanges 60, 62 of lever arm 10.

Punch pin 4 is received in a bayonet opening in lever arm 8, the edges of the opening engaging an axially-elongated annular recess 66 (see particularly FIG. 2) formed at the upper end of the pin. Similarly, punch pin 6 is received within a bayonet opening 68 in the upper lever arm 10, the edges of this opening engaging an axially-elongated annular recess 70 formed at the upper end of this punch pin.

The hand punch illustrated in FIGS. 1–5 is used in the following manner: The paper sheet 30 to be punched is inserted into the slot 29 between legs 12 and 13 of the base 2, its edge limiting against web 28 (see FIG. 3). Lever arm 10 is then manually depressed. By virtue of the pin 56 and slot 58 connection between the two lever arms, both of the punch pins 4, 6, carried by these two lever arms are forced through the paper sheet and into the chad compartment 25 (see FIGS. 4 and 5). This depression of the lever arms 8, 10 and the punch pins 4, 6 flexes the ends 36, 38 of the leaf spring 32, so that as soon as the manual pressure is released, the leaf spring returns the punch pins and the lever arms to their normal positions.

It will be seen that, since the two lever arms 8 and 10 are pivotably mounted about pivotal axes (pins 52, 54) which are parallel to the width of the hand punch base 2, rather than to the length of the base as in the prior devices, the manual pressure for effecting the punching operation can be applied substantially along the line of the two punch pins 4, 6. Accordingly, the hand punch can take a very narrow construction. In addition, making the base of a multi-leg channel member, e.g., by extrusion or bending continuous lengths and then cutting to size, substantially simplifies the construction of the hand punch, thereby enabling them to be produced very inexpensively and in a very compact form.

FIG. 6 illustrates a slight modification wherein the multi-leg channel member used as the base 2 is closed along both sides of the two legs 13, 14, as shown at 71, 72, rather than only along one side as illustrated in FIGS. 1–5, in order to provide reinforcement for the base. Such a modification is easily obtained when the multi-leg channel member used as the base 2 is made of a continuous extrusion, such as of metal (e.g. aluminum) or plastic.

Figure 8:
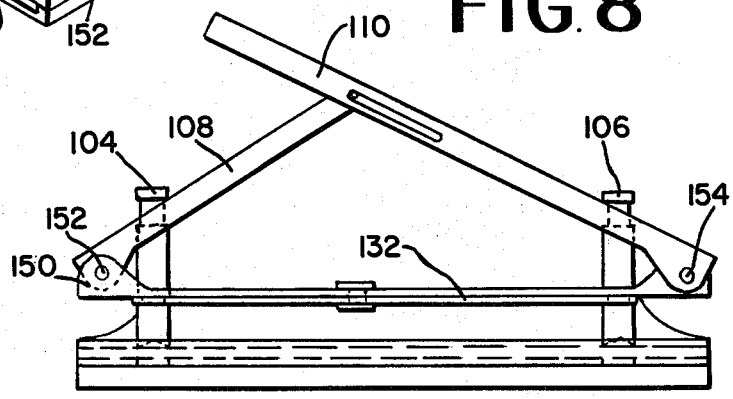
FIG. 8 is a side elevational view of the hand punch of FIG. 7.
Figure 9:
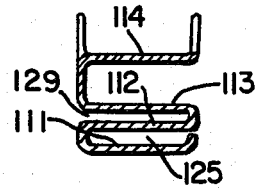
FIG. 9 is a sectional view of the multi-leg channel member used in the base of the hand punch of FIG. 7.

FIGS. 7–9 illustrate another modification of the hand punch wherein the multi-leg channel member used as the base is made by bending sheet material rather than by extrusion. Except for this difference, the hand punch of FIGS. 7–9 is otherwise of the same construction as described above with respect to FIGS. 1–5.

Thus, the base, generally designated 102, is also formed with a multi-leg channel member including the four legs 111, 112, 113 and 114, all disposed in overlying spaced relationship to each other and defining between legs 111 and 112 a compartment 125 for the paper chips, and between legs 112 and 113, a slot 129 for receiving the paper sheet (not shown) to be punched. The return leaf spring 132 is mounted to the underside of leg 114 and is used for returning the punch pins 104, 106, and the two lever arms 108, 110, in the same manner as described above.

The lever arms 108 and 110 are mounted in the same manner as described above along axes parallel to the width of the hand punch, via pins 152 and 154, respectively. In this case, the upper leg 114 is provided with upstanding ears 150 (instead of flanges 48, 50 in FIGS. 1–5) for mounting the pivotal pins 152, 154. The punch pins 104 and 106 are received in bayonet openings in the two lever arms 108, 110 in the same manner as described above.

It will be seen that the hand punch illustrated in FIGS. 7–9 has the constructional advantages and operates in the same manner as described above with respect to FIGS. 1–5.

Figure 10:
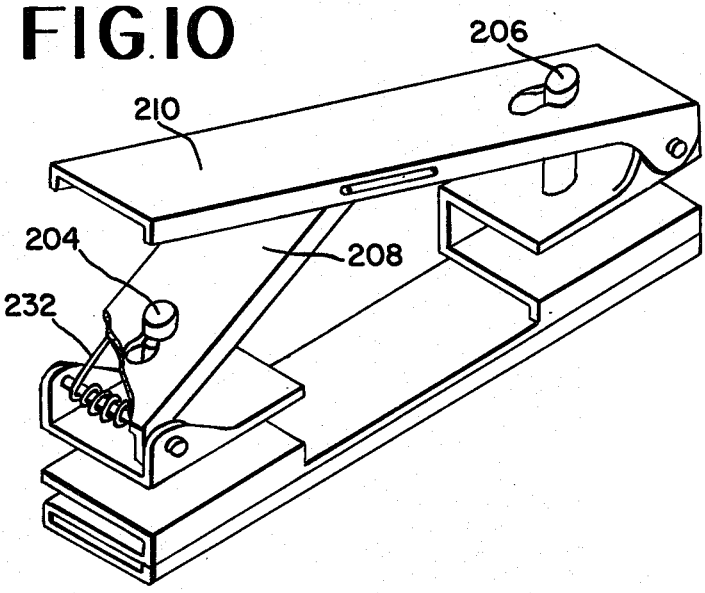
FIG. 10 is a three-dimensional view illustrating a further modified form of hand punch constructed in accordance with the invention.

FIG. 10 illustrates a modification in the hand punch of FIGS. 7–9, wherein, instead of having the two upper legs 113, 114 of the multi-leg base 102 extend for their complete length, both are cut at their intermediate portions, thereby producing a substantial savings in material and weight. Since this arrangement does not provide a mounting for the leaf spring (32 or 132) for returning the parts to their normal positions, the return springs in this case are in the form of coil springs 232, 233 at the pivotal mounting of the two lever arms 208 and 210 urging them, and their punch pins 204, 206, to their normal positions.

Many other variations, modifications and applications of the invention will be apparent.

What is claimed is:

1. A hand punch comprising: a base having a substantially longer length than width, said base being formed with a plurality of punch pin openings arranged in a straight line along the length of the base, and with a slot overlying said openings for receiving a sheet to be punched, a plurality of punch pins each normally overlying said slot and one of said openings and movable therethrough upon the manual depression of the punch; a manual operator for depressing said punch pins through said openings, said manual operator including a first lever arm pivotably mounted to one end of said base along a first pivotable axis parallel to the width of the base, and a second lever arm pivotably mounted to the opposite end of said base along a second pivotal axis parallel to said first pivotal axis; said second lever arm overlying, and being longer than, said first lever arm and having an intermediate portion coupled by a slidable connection to the end of said first lever arm opposite to the pivotably mounted end of the first lever arm; and spring return means returning the two lever arms and the plurality of punch pins upon release of said manual operator.

2. A hand punch according to claim 1, wherein said base comprises a multi-leg channel member elongated in the direction of the length of the base, said channel member including a first leg, and a second leg spaced thereover and provided with said punch pin openings, said second leg defining with said first leg a compartment for receiving the paper chips punched by the punch pins.

3. A hand punch according to claim 2, wherein said channel member further includes a third leg spaced over said second leg and formed with punch pin openings aligned with those of the second leg for guiding the punch pins, said second and third legs defining said sheet-receiving slot, the latter being open at one side for receiving the sheet to be punched by said punch pins and closed at the opposite side for positioning said sheet with respect to said punch pins.

4. A hand punch according to claim 3, wherein said channel member includes a fourth leg spaced over said third leg and formed with punch pin openings aligned with those of the third leg for guiding the punch pins.

5. A hand punch according to claim 4, wherein said spring return means comprises leaf spring means secured to the underside of said fourth leg and having a free end and engaging each of said punch pins.

6. A hand punch according to claim 5, wherein there are two of said punch pins, said leaf spring means comprising a single leaf spring secured at its intermediate point to the underside of said fourth leg, the opposed ends of said leaf spring engaging said two punch pins.

7. A hand punch according to claim 4, wherein said first and second lever arms are pivotably mounted to the opposite ends of said fourth leg of the base.

8. A hand punch according to claim 1, wherein there are two of said punch pins, one received in an opening formed in the first lever arm, and the second received in an opening formed in the second lever arm.

9. A hand punch according to claim 8, wherein said return spring means comprises a leaf spring fixed at an intermediate point to the base, the opposite ends of the leaf spring bring free and engaging said punch pins to urge them and their lever arms to their normal positions.

* * * * *